US006325618B1

(12) United States Patent
Benz et al.

(10) Patent No.: US 6,325,618 B1
(45) Date of Patent: Dec. 4, 2001

(54) FUEL LANCE FOR SPRAYING LIQUID AND/OR GASEOUS FUELS INTO A COMBUSTION CHAMBER

(75) Inventors: Urs Benz, Gipf-Oberflick (CH); Franz Joos, Weilheim-Bannholz (DE); Adnan Eroglu, Untersiggenthal (CH)

(73) Assignee: Alstom (Switzerland) Ltd., Baden (CH)

( * ) Notice: Subject to any disclaimer, the term of this patent is extended or adjusted under 35 U.S.C. 154(b) by 0 days.

(21) Appl. No.: 09/503,709

(22) Filed: Feb. 14, 2000

(30) Foreign Application Priority Data

Feb. 15, 1999 (DE) ..... 199 05 996

(51) Int. Cl.[7] ..... F23D 17/00
(52) U.S. Cl. ..... 431/187; 239/422; 239/424.5
(58) Field of Search ..... 431/8, 187; 239/418, 239/422, 424, 428, 424.5, 549; 60/742

(56) References Cited

U.S. PATENT DOCUMENTS

| | | | | |
|---|---|---|---|---|
| 4,077,761 | * | 3/1978 | Dollinger et al. | 431/8 |
| 4,406,610 | * | 9/1983 | Duijvestijn | 431/8 |
| 4,850,194 | * | 7/1989 | Füglistaller et al. | 60/742 |
| 4,854,127 | | 8/1989 | Vinson et al. . | |
| 5,101,633 | * | 4/1992 | Keller et al. | 60/742 |
| 5,431,018 | | 7/1995 | Keller . | |
| 5,487,659 | * | 1/1996 | Eroglu et al. | 431/183 |
| 5,626,017 | | 5/1997 | Sattelmayer . | |
| 5,857,846 | * | 1/1999 | Sattelmayer et al. | 431/187 |

FOREIGN PATENT DOCUMENTS

| | | |
|---|---|---|
| 43 26 802 | 2/1995 | (DE) . |
| 195 35 370 | 3/1997 | (DE) . |
| 0 597 221 | 5/1994 | (EP) . |
| 0 620 362 | 10/1994 | (EP) . |
| 0580078008 | 5/1983 | (JP) . |

* cited by examiner

*Primary Examiner*—Ira S. Lazarus
*Assistant Examiner*—Sara Clarke
(74) *Attorney, Agent, or Firm*—Burns, Doane, Swecker & Mathis, L.L.P.

(57) ABSTRACT

A fuel lance for spraying liquid and/or gaseous fuels into a combustion chamber, which fuel lance is provided with first means for the radial spraying of the liquid fuel from the liquid-fuel passage into the combustion chamber. The first means comprise a first guide tube, which, in the radial direction starting from the liquid-fuel passage, runs outward through a gas passage and an air passage. In addition, second means are provided, which comprise a second guide tube, which, in the radial direction starting from the gas passage, runs outward through the air passage and concentrically surrounds the first guide tube at a distance. Both guide tubes open in the region of a shell opening in the lance shell in such a way that the liquid-fuel jet discharging from the first guide tube discharges as a plain jet into the combustion chamber, and the fuel jets discharging from the guide tubes are surrounded in a sheath-like manner by the air flowing out of the air passage through the shell opening.

6 Claims, 2 Drawing Sheets

FUEL LANCE FOR SPRAYING LIQUID AND/OR GASEOUS FUELS INTO A COMBUSTION CHAMBER

FIELD OF THE INVENTION

The present invention relates to the field of combustion technology, as used in particular in gas turbines. It relates to a fuel lance for spraying liquid and/or gaseous fuels into a combustion chamber.

BACKGROUND OF THE INVENTION

Publication DE-A1-43 26 802 discloses a fuel lance, for spraying liquid or gaseous fuels into a combustion chamber. The fuel lance is part of an secondary or tertiary burner, around which a combustion air jet flows in a main flow direction, and comprises inside an outer lance shell a liquid-fuel passage for supplying liquid fuel, a gas passage surrounding the liquid-fuel passage and intended for supplying gaseous fuel, and an air passage surrounding the gas passage and intended for supplying cooling or atomizing air, and first means for the radial spraying of the liquid fuel from the liquid-fuel passage into the combustion chamber, and second means for the radial spraying of the gaseous fuel from the gas passage into the combustion chamber see publications U.S. Pat. Nos. 5,431,018, 5,626,017 and EP-A1-0 620 362). In this case, the nozzles for gaseous fuel and liquid fuel (oil, etc.) are combined.

In the publication referred to, the spraying of the liquid fuel is effected according to the so-called air-blast principle, i.e. the fuel applied as a film to an atomizer lip is atomized in the shearing zone of the surrounding air flow and is admixed to the combustion air as a fuel mist. If the spraying is effected transversely to the flow direction of the combustion air, the penetration depth is determined solely by the air impulse. The natural impulse of the liquid fuel is merely utilized for producing the film but not for assisting the fuel jet.

To produce as homogenous an air/fuel mixture as possible, it is necessary for the fuel from the wake of the nozzle to be distributed in the cross section of the combustion air. During high transverse flows, a correspondingly high jet impulse is necessary. This high jet impulse cannot be achieved with the atomizing air alone. Therefore the natural impulse of the sprayed liquid fuel (or the gaseous fuel) is to be utilized in an assisting manner. The disintegration of the fuel jet is effected by jet instabilities after a few jet diameters of running length.

SUMMARY OF THE INVENTION

The object of the invention is therefore to provide a fuel lance for the, spraying of liquid fuel and/or gaseous fuel into a secondary or tertiary burner, which fuel lance avoids the abovedescribed disadvantages of previous lances and permits in particular a reduction in the retention time of the liquid fuel in the premix section and thus a reduction in the admixed proportion of water.

The object is achieved by spraying the liquid fuel as a plain jet radially to the main flow direction by means of a suitable guide-tube arrangement. The result of this type of spraying is that the retention time of the liquid fuel in the premix section is reduced and thus less water has to be added in order to prevent a flame flashback. A further advantage is the improved air/fuel mixture due to this arrangement. In particular, the existing air-flow zone, already optimized for the gas spraying, of the main flow may thus also be utilized for the atomizing and mixing of the liquid fuel.

Especially favorable flow conditions result if, in a first preferred embodiment of the fuel lance according to the invention, the two guide tubes end flush with the inner contour of the lance shell.

The spraying of the gaseous fuel and of the surrounding air sheath is of especially favorable configuration if, in a second preferred embodiment, the second guide tube, in the region of the air passage, narrows conically in outside diameter toward the orifice, and the first guide tube, in the region of the gas passage, narrows conically in outside diameter toward the orifice.

BRIEF DESCRIPTION OF THE DRAWINGS

The invention is to be explained in more detail below with reference to preferred embodiment.

DESCRIPTION OF THE INVENTION

Figure 1:
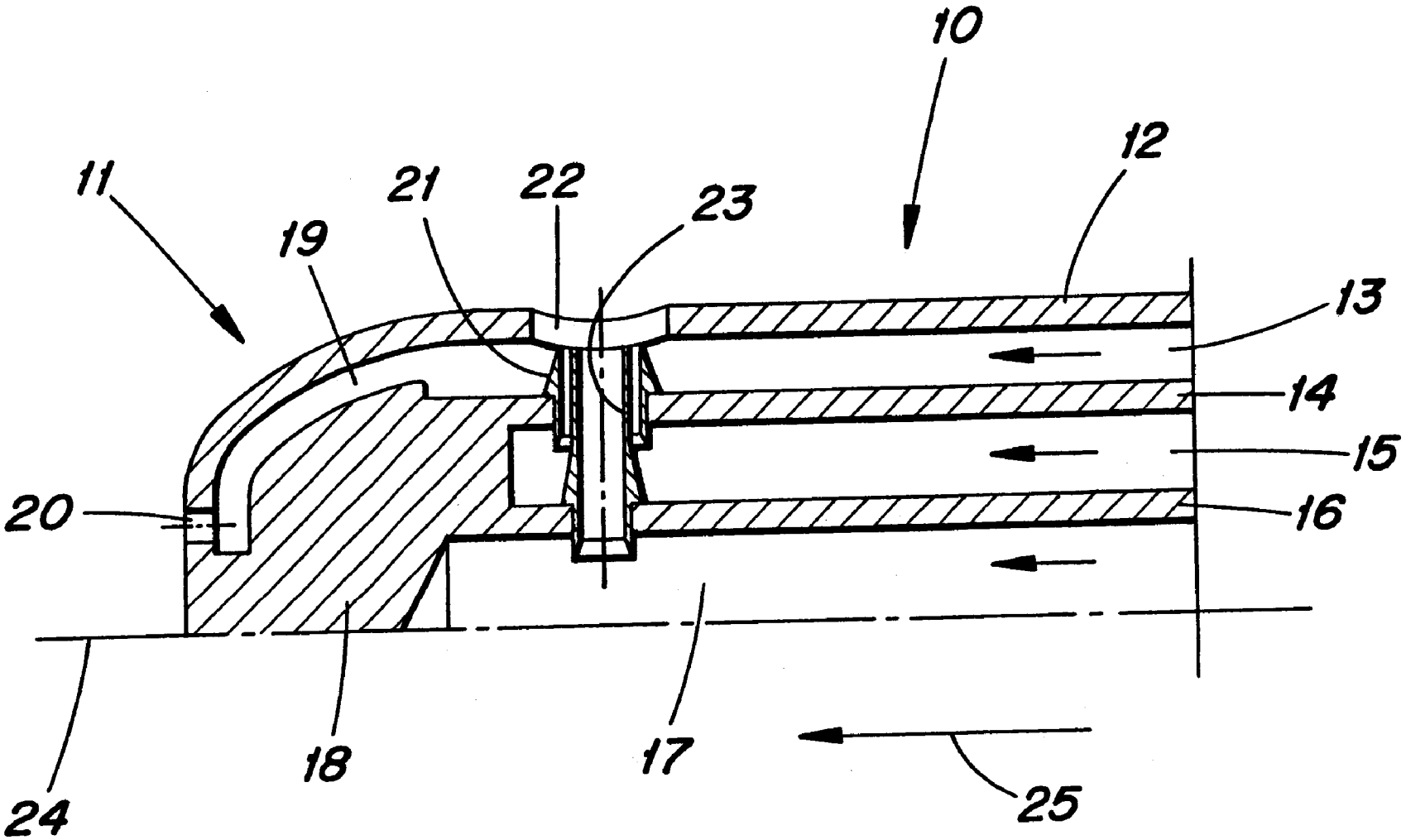
FIG. 1 is a longitudinal cross-section view of the head region of a fuel lance in a preferred embodiment of the invention, with radial spraying of the gaseous fuel and the liquid fuel through two guide tubes arranged concentrically one inside the other.
Figure 2:
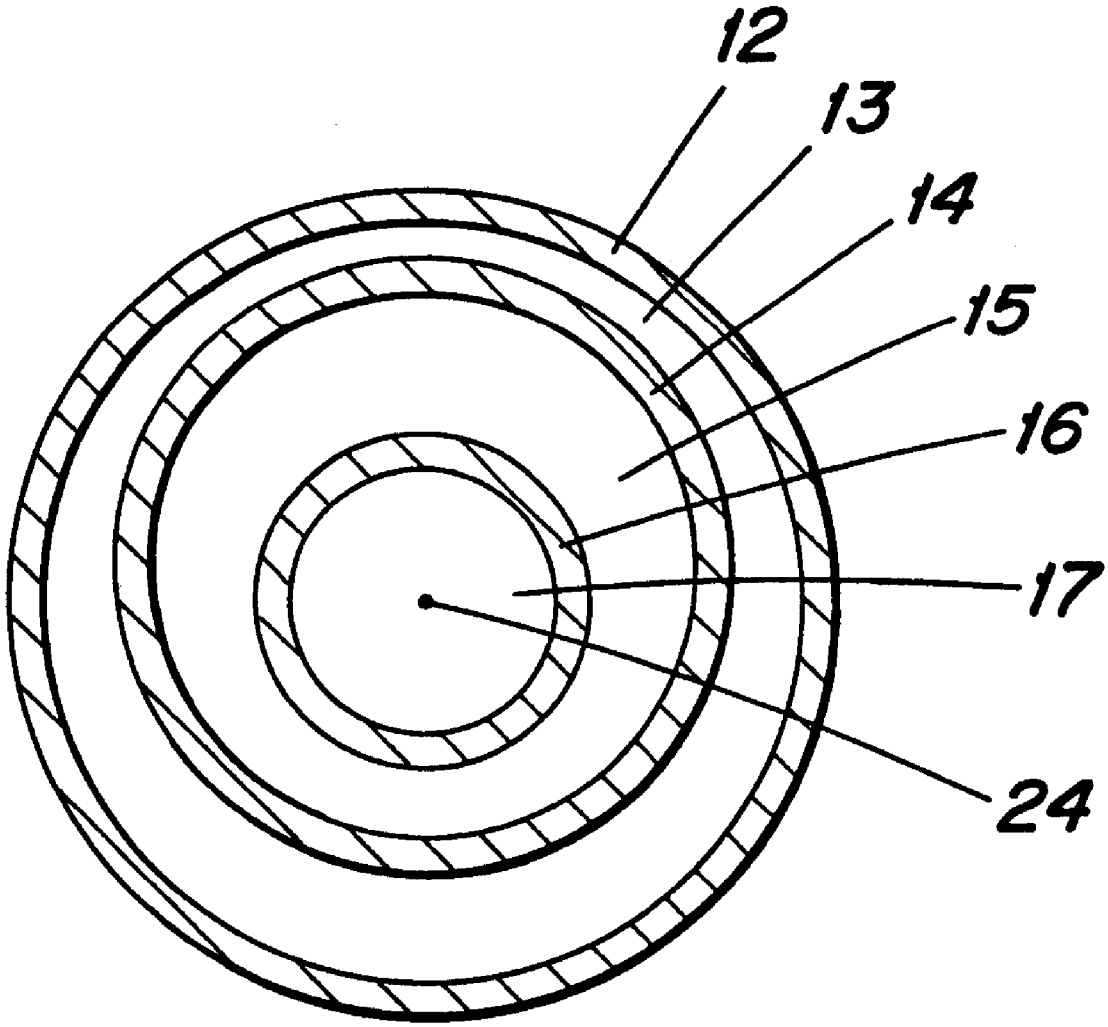
FIG. 2 is a cross sectional view of the fuel lance with one of the passages arranged eccentrically.

A preferred embodiment of a fuel lance according to the intention is reproduced in longitudinal section in the single figure. The fuel lance 10, which extends along a lance axis 24, which in turn lies essentially parallel to the main flow direction 25 of a combustion-air flow flowing around the lance, is shown in the figure only with its head region. A liquid-fuel tube 16, a gas tube 14 and a lance shell 12 are arranged one inside the other in the fuel lance 10 concentrically to the lance axis 24. The interior of the liquid-fuel tube 16 forms a liquid-fuel passage 17, through which liquid fuel, in particular oil or the like, is directed for spraying in the direction of the arrow depicted into the lance head 11. Formed between the liquid-fuel tube 16 and the gas tube 14 is a gas passage 15, through which gaseous fuel is directed in the direction of the arrow depicted for spraying into the lance head 11. Finally, an air passage 13, through which air is directed into the lance head 11 in the direction of the arrow depicted, is formed between the gas tube 14 and the lance shell 12. Instead of the concentric arrangement of the tubes 12, 14 and 16 which is shown in the figure, it is in certain cases conceivable and also advantageous for the tubes to be arranged in such a way that the gas passage 15 or the liquid-fuel passage 17 is arranged eccentrically.

According to the invention, the liquid fuel from the liquid-fuel passage 17 is sprayed radially in the form of a plain jet into the combustion chamber, into which the fuel lance 10 projects. Provided for the spraying is a first guide tube 23, which starts in the radial direction from the liquid-fuel passage 17 and ends In the region of a (circular) shell opening 22 in the lance shell 12. The gaseous fuel is likewise sprayed from the gas passage 15 radially to the lance axis 24 and thus radially to the main flow direction 25 into the combustion chamber. Provided for this purpose is a second guide tube 21, which starts in the radial direction from the gas passage 15 and likewise ends in the region of the shell opening 22. Both guide tubes 21, 23 are arranged concentrically one inside the other at a distance apart, so that the gaseous fuel is directed in the annular gap which is formed in this way between the two guide tubes 21, 23. The diameter of the shell opening 22, relative to the outside diameter of the second guide tube 21, is selected in such a way that an annular gap remains free for producing a protective air sheath surrounding the gas jet. The flow conditions for the air-sheath flow are especially favorable if the two guide tubes 21, 23—as shown in the figure—end flush with the inner contour of the lance shell 12.

The deflection of the flows from the gas passage 15 and the air passage 13 from the axial direction into the radial direction and the formation of the desired shell flows can be further facilitated if the second guide tube 21, in the region of the air passage 14, narrows conically in outside diameter toward the orifice, and the first guide tube 23, in the region of the gas passage 15, narrows conically in outside diameter toward the orifice.

Furthermore, if necessary, air may be directed in a manner known per se into the lance head from the air passage 13 in order to cool the head part 18 and produce an axial air veil. To this end, axial bores 20, through which air can discharge in the axial direction, are arranged around the lance axis 24 on a concentric ring. The air required for this purpose is fed in from the air passage 13 via a head passage 19, which runs in the marginal region through the lance head 11. This achieves the effect that the lance head 11 is also cooled by the air flowing through.

What is claimed is:

1. A fuel lance for spraying liquid and/or gaseous fuels into a combustion chamber, which fuel lance is part of a secondary or tertiary burner, around which a combustion air jet flows in a main flow direction, comprising: an outer lance shell, the shell having a shell opening, a liquid-fuel passage for supplying liquid fuel, a gas passage surrounding the liquid-fuel passage and intended for supplying gaseous fuel, and an air passage surrounding the gas passage and intended for supplying cooling or atomizing air, and first means for the radial spraying of the liquid fuel from the liquid-fuel passage into the combustion chamber, and second means for the radial spraying of the gaseous fuel from the gas passage into the combustion chamber, the first means having a first guide tube, which, in the radial direction starting from the liquid-fuel passage runs outward through the gas passage and the air passage, the second means having a second guide tube, which, in the radial direction starting from the gas passage, runs outward through the air passage and concentrically surrounds the first guide tube at a distance, the two guide tubes having discharge openings adjacent to the shell opening in the lance shell, the first guide tube being arranged to provide a jet of liquid fuel as discharged through the shell opening, the second guide tube being arranged to provide a jet of gaseous fuel as discharged through the shell opening and the air discharging from the air passage through the shell opening being arranged to provide a sheath of air around the jets of fuel.

2. The fuel lance as claimed in claim 1, wherein the outer lance shell has an inner surface, and the two guide tubes end flush with the inner surface of the lance shell.

3. The fuel lance as claimed in claim 1, wherein the portion of the second guide tube that passes through the air passage, narrows conically in outside diameter toward the shell opening.

4. The fuel lance as claimed in claim 1, wherein the first guide tube, in the region of the gas passage, narrows conically in outside diameter toward the orifice.

5. The fuel lance as claimed in claim 1, wherein the liquid-fuel passage and the gas passage are arranged concentrically to one another.

6. The fuel lance as claimed in claim 1, wherein the lance has an axis, and the liquid-fuel passage or the gas passage is arranged eccentrically in relation to the lance axis.

* * * * *